United States Patent [19]

Bain, Jr.

[11] 4,170,835

[45] Oct. 16, 1979

[54] IRON WITH MODE VALVE

[75] Inventor: Benjamin H. Bain, Jr., Monroe, Conn.

[73] Assignee: General Electric Company, New York, N.Y.

[21] Appl. No.: 955,354

[22] Filed: Oct. 27, 1978

[51] Int. Cl.[2] ..... D06F 75/06

[52] U.S. Cl. ..... 38/77.5; 38/77.83

[58] Field of Search ..... 38/77.5, 77.7, 77.8, 38/77.81, 77.82, 77.83; 251/180, 304

[56] References Cited

U.S. PATENT DOCUMENTS

| | | | |
|---|---|---|---|
| 1,953,448 | 4/1934 | Thaete et al. | 251/304 X |
| 3,082,791 | 3/1963 | Miller | 251/180 X |
| 3,599,357 | 8/1971 | Gronwick et al. | 38/77.5 |
| 3,685,181 | 8/1972 | Davidson | 38/77.5 |
| 3,691,660 | 9/1972 | Gronwick et al. | 38/77.83 |
| 3,703,043 | 11/1972 | Ogata et al. | 38/77.83 |
| 3,711,972 | 1/1973 | Risacher | 38/77.83 |
| 3,758,969 | 9/1973 | Davidson | 38/77.5 |

*Primary Examiner*—Louis Rimrodt

*Attorney, Agent, or Firm*—John F. Cullen; George R. Powers; Leonard J. Platt

[57] ABSTRACT

In a conventional iron an improvement is provided in the mode valve subassembly that includes a molded cup-shaped valve housing with an upright closed peripherally extending side wall with a pair of spaced stops, the side wall enclosing a flat bottom wall all mounted within the handle.

5 Claims, 6 Drawing Figures

2/2

IRON WITH MODE VALVE

BACKGROUND OF THE INVENTION

1. Field of the Invention

The invention herein pertains to an electric steam flatiron with plural surge and spray functions with a handle-mounted manual spray pump and a separate handle-mounted mode selector valve subassembly combination with the improvement being made in the details of the mode valve subassembly permitting an inexpensive, easily assembled, set of components to select either steam or extra surge on demand by separate actuation of the handle mounted pump.

2. Description of the Prior Art

With the advent of irons using water for either steam or spray or both, a water tank is provided in the iron above the soleplate and water valve structure is provided for metered drippage of water into a steam generator where it is evaporated and flashed into steam and directed out ports in the soleplate to steam the article. In order to provide extra steam capacity, irons also have means whereby an extra slug of water may be pumped into the steam generating area, usually into a separate chamber, whereupon the extra surge of steam may be fed into the distribution system to exit the soleplate ports as extra capacity steam. Different types of surge steam have been provided whereby the surge steam and main steam are both fed directly into a main distribution system as in U.S. Pat. No. 3,599,357 and where the extra steam may be passed first through the main generator and then into the distribution system to exit as surge steam as in U.S. Pat. No. 3,711,972. Still another system as in U.S. Pat. No. 3,703,043 allows generated steam to be shifted from one group of soleplate ports to another group so it exits vigorously through a few ports or softly through many ports depending on the needs of the fiber being ironed. It is also known to provide an iron wherein a single control handles both spray water and surge steam through a combined structure wherein a single pump both pumps the water and selects the exit for spray or surge by including a valve mechanism directly in the pump and such structure is shown in U.S. Pat. No. 3,691,660. The present invention is directed to such an electric flatiron with plural surge and spray functions wherein a unique, easily assembled and inexpensive mode selector valve, separate from the pump structure, is supplied to direct water either to surge or spray in a simplified valve subassembly, the separateness from the pump being desired for reasons that will become apparent.

SUMMARY OF THE INVENTION

Briefly described, the present invention is directed to an electric steam flatiron with plural surge and spray functions, the iron being supplied with a water tank, a steam generating soleplate with ports for distributing normal steam and/or extra surge steam on demand, a handle with spray means and a separate pump connected to the water tank with a button on the handle for manual pump actuation to deliver water to the soleplate surge or handle spray means as directed by a separate handle-mounted mode selector valve subassembly. To this general combination an improvement in the mode valve subassembly is provided comprising a molded cup-shaped valve housing with an upright closed peripheral side wall having spaced stops and the side wall enclosing a flat bottom wall, the entire housing being mounted within the iron handle. A plurality of outlets is provided through the bottom wall and an integral flexible seal including a cup-shaped disc with molded integral tubes extending through the outlets seats the disc in the housing. The disc has separate annular walls around each outlet protruding into the housing cup forming a water chamber therein. One of the two protruding outlet walls may have side openings connecting with the chamber at one end and with the water tank at the other to maintain the chamber full of water at all times. A flat gate with an actuating arm extending through the iron handle is provided and has a projection rotatably nesting snugly in the cup housing to seal against the protruding walls of the outlets. The projection has an arcuate channel connecting at any one time only two of the outlets one of which is the water-supplying tube and a U-shaped spring means clamps and compresses the gate and disc together in a watertight sealing arrangement. The gate has peripheral stops to abut the spaced stops on the housing side wall such that the actuating arm external of the handle is rotatable against the stops to selectively direct water to the spray and extra surge functions for proper water direction on separate pump actuation to maintain a simple pump construction. Thus, the main object of the invention is to disclose a steam iron with surge and spray functions and to provide a unique handle mounted mode selector valve subassembly for selecting the proper function.

DESCRIPTION OF THE PREFERRED EMBODIMENT

Figure 1:
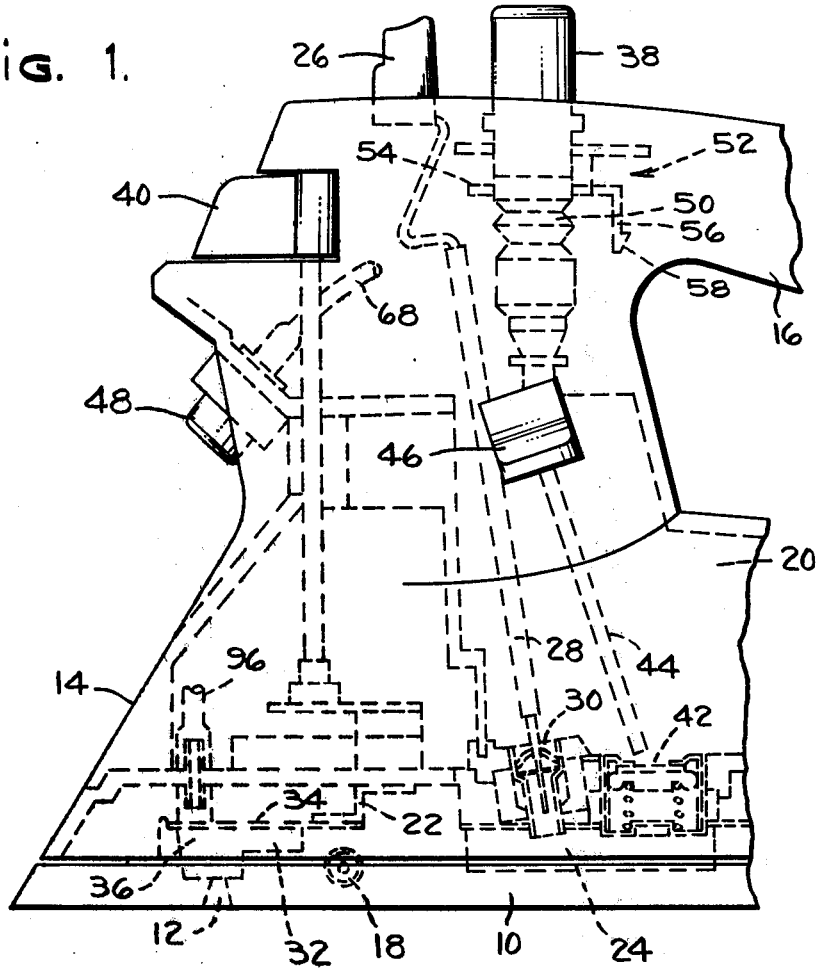
FIG. 1 is a partial elevation of a typical spray and surge steam iron partly showing the invention.
Figure 2:
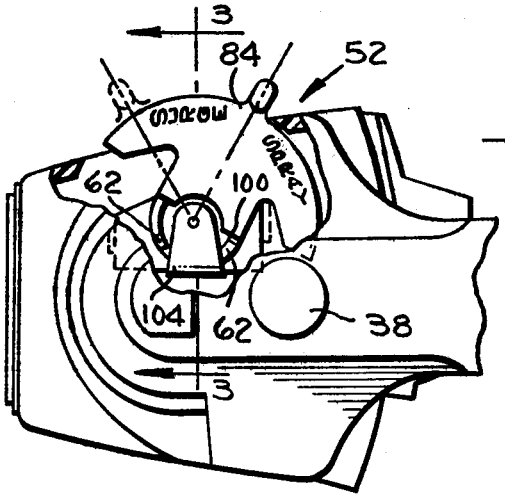
FIG. 2 is a top view, partially broken, of the front portion of the iron handle showing the mode selector valve.

Referring to FIG. 1, for convenience there is shown an electric steam iron generally of the self-cleaning variety of the type shown in U.S. Pat. No. 3,747,241 of common assignment and generally known as the basic self-cleaning steam iron patent from which numerous patented improvements have followed. As such, the iron includes a soleplate 10 with a plurality of steam ports 12 and an outer shell 14 suitably connected or forming part of handle 16 in known fashion. Soleplate 10 conveniently may be cast from aluminum with an electric heating element 18 cast in position and disposed so uniform heat distribution is provided when the iron is plugged in and activated. Any other suitable means of heating the soleplate may be employed and self-clean can be omitted.

The iron includes means for generating steam by providing water tank 20 that may be part of a single plastic housing positioned by bracket 22 and other suitable mechanism in conventional fashion. For steam, soleplate 10 has a steam generator 24 into which, under control of button 26 and guided valve stem 28 movable between an on/off position, water controllably drips from tank 20 onto hot soleplate 10 through metering water valve 30 of a known type, the resulting steam being distributed through distributing passages 32 under coverplate 34 and out ports 12 onto the fabric being ironed. In the embodiment shown, an additional surge is provided by injecting water into a separate forward surge generator 36 by a separate manual bellows type pump control button 38 and a temperature control 40 thermostatically controls the soleplate heat. All the structure thus described is generally well-known.

One of the main features in the self-cleaning iron is provision for suddenly and completely dumping tank 20 onto the hot soleplate through a substantially large opening that preferably, although not necessarily, is spaced and separate from the usual water valve 30. Controlling this large opening, a dumper valve 42 is disposed in the bottom of the water tank, and operates to quickly empty the tank onto the soleplate where the combination of hot water and steam suddenly created forcefully steams out and purges or cleans the internal passages, tank, and soleplate ports of lint and internal deposits. The dumper valve is operated through a rod 44 under control of a separate handle-mounted dumper control knob 46 and this structure is generally known and shown in U.S. Pat. No. 3,747,241 supra. The iron shown is also equipped with spray nozzle 48 of the general type such as shown in U.S. Pat. No. 3,664,045 of common assignment except that it is operated directly by manual bellows pump 50 rather than a diaphragm pump.

The iron structure described is generally conventional and is an iron of multi functions having spray, extra surge, and self-cleaning capabilities. In order to prevent inadvertent operation through a single control, it is desired to use separate controls for each of the functions and to this end dumper knob 46 is deliberately placed on the side of the handle so that it cannot be operated except by using both hands, one hand to hold the iron, and one hand to operate the dumper knob, a safety feature. Similarly, it is desired to operate the spray and extra surge functions separate from the pump control button 38 which supplies the hot steam by extra water so that the button 38 is used only as a separate pump thus again requiring use of both hands to switch from one function to another to prevent a surge of hot steam when spray is desired or vice versa. The arrangement is such that the operator's hands are required to select the desired function.

Figure 4:
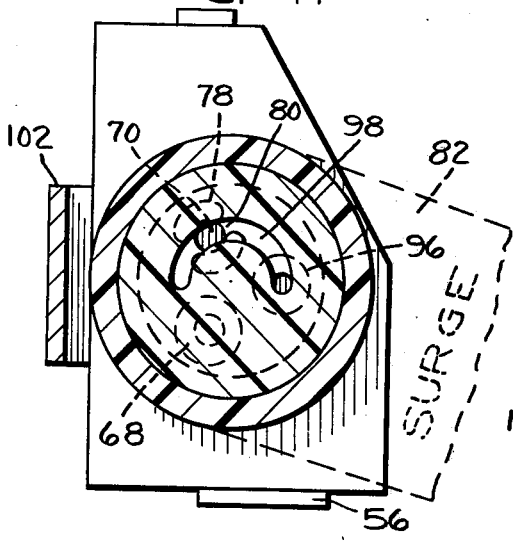
FIG. 4 is a view on line 4—4 in FIG. 3 with a slight modification and with the gate actuating arm in "surge" in phantom.
Figure 5:
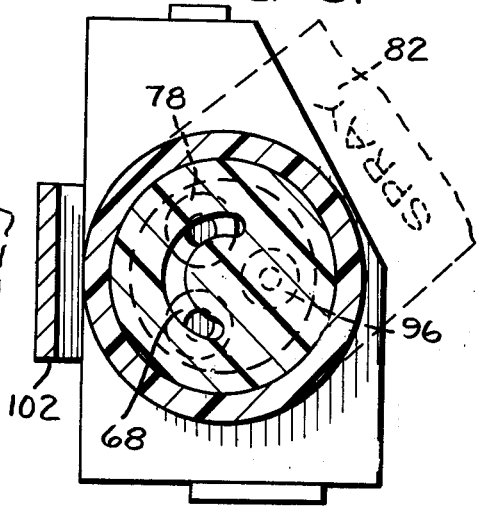
FIG. 5 is a view, similar to FIG. 4, showing the structure in "spray" position.
Figure 6:
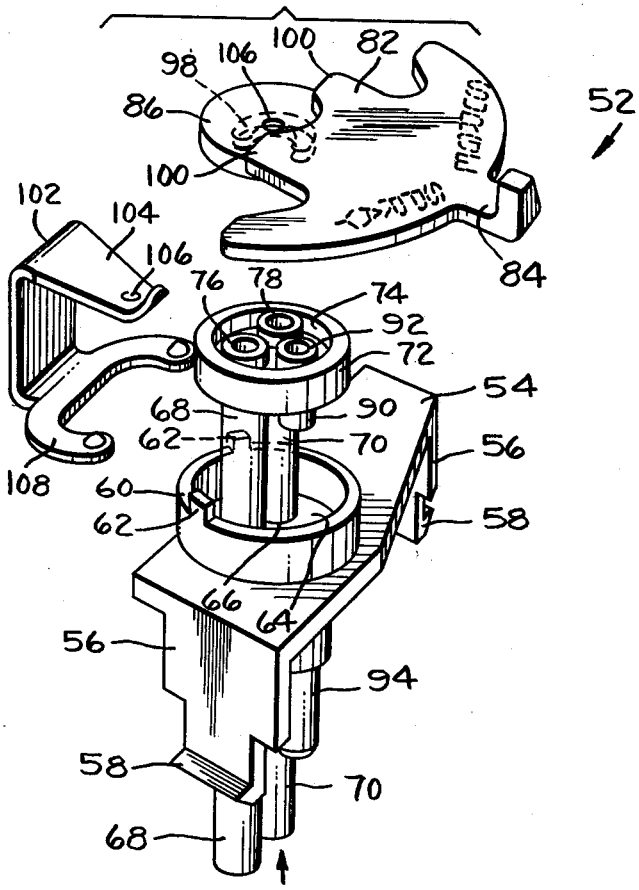
FIG. 6 is an exploded perspective of the mode selector valve subassembly.

In accordance with the present invention, an improved separate handle-mounted mode selector valve subassembly 52 is supplied to select either surge or spray and such valve detailed parts is shown in FIGS. 2–6 and would appear in FIG. 1 just forward of and with the operable arm on the far side of handle 16 as shown generally at 52. It is desired to have an inexpensive generally molded plastic flexible selector valve subassembly that uses a minimum number of parts and is easily put together on the assembly line while still providing the necessary fluid tightness and reliable operation in either of the multi surge or spray functions disclosed. To this end, reference is made to FIG. 6 where the general components of the mode valve subassembly are shown exploded. This subassembly comprises a molded plastic cup-shaped valve housing 54 that is conveniently made in a U-shape with depending legs 56 having barbs 58 on the end of each leg. The generally U-shaped plastic has an inherent spring resiliency so that the barbs are forced out and may be forced under suitable overhanging portions, not shown, within the handle to secure the housing within the iron handle. Alternately, a single leg 56 with an elongated upper part of stepped extension 94 (explained later) may be used as seen in FIG. 1. As shown, the housing is suitably molded to fit within the confines of the matching opening within the handle 16. An upright closed peripheral sidewall 60 is molded as part of the housing to form the cup shape and has spaced stops 62 along its upper rim for a purpose to be explained. Completing the cup shape, the sidewall 60 encloses a flat bottom wall 64 through which and extending below the housing 54 is a series of spaced outlets 66, two being shown to accommodate flexible elastomeric tubes 68 and 70 with tube 70 extending downwardly forming an inlet water tube. For proper orientation during assembly, the outlets 66 are adjacent and off center in the bottom wall 64 as shown in FIG. 6.

Figure 3:
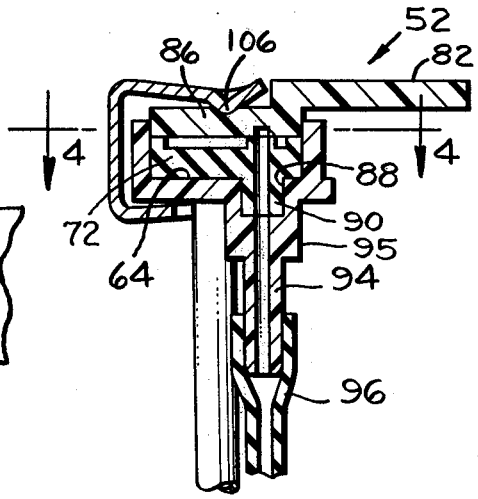
FIG. 3 is a cross-sectional view on line 3—3 of FIG. 2.

In order to form a tight sealing water chamber, a separate flexible and molded cup-shaped disc 72 is provided as an integral part of tubes 68 and 70 and is designed to nest snugly in side wall 60 of the housing as seen in FIG. 3. Thus, the disc 72, with its molded integral tubes 68 and 70 is accurately aligned to seat the disc in the cup housing formed by wall 60. In order to form a water chamber within disc 72, the upper portion of the tubes extending into a water chamber 74 are formed with separate annular walls 76 and 78 around each outlet in the disc with the walls protruding into the cup portion to form water chamber 74. In other words, the annular walls 76 and 78 limit any cover enclosure thus forming water chamber 74. In order to provide entrance of water at all times to chamber 74, the protruding annular wall 78 at the one end of water inlet tube 70 may be split to have side openings 80 that connect with chamber 74 thus insuring that water can enter chamber 74 at all times as seen in FIG. 4. As described below, this split and side opening's 80 may be omitted to simplify the construction as shown in FIGS. 5 and 6. For completing the water chamber 74 to provide a selection for the functions of surge or spray, a flat plastic gate 82 is provided with an actuating arm 84 extending through the side of the iron handle for rotation to indicate a suitable surge or spray function as respectively shown in FIGS. 4 and 5 as will become apparent. Closing the top of cup disc 72 is a molded offset matching projection 86 that rotatably nests snugly in the cup housing and, acting like half O-rings, seals flat against the protruding walls 76 and 78 to form the sealed water chamber 74. For an additional function and further orientation of cup disc 72, a third outlet 88 is formed in the flat bottom wall 64 to accommodate a nipple 90 which is integrally formed with the cup disc 72 and also has comparable protruding walls 92 within water chamber 74 like the other two flexible tubes. Nipple 90 aligns itself in a corresponding stepped housing support extension 94 formed as part of housing 54 and extending below it as seen in FIG. 3. Extension 94 is formed to receive a removable flexible tubing 96 form one of the extra iron functions, such as the surge function, with the tube 96 being directed to surge generator 36 as seen in FIG. 1. As described above, a single leg 56 (FIG. 1) on valve housing 54 may be used in which case the upper part 95 of stepped support extension 94 is lengthened to better steady the valve housing 54 in the handle with the single leg 56.

For directing the incoming water in tube 70 into water chamber 74, the projection 86 on the gate 82 has an arcuate channel 98, a type of connecting arrangement generally known, on its underside with the channel extending sufficiently around to connect only two outlets at any one time, one outlet channeling water to tube 96 for the surge function of the iron as shown in FIG. 4 and the other rotated position of gate 82 channeling the water to tube 68 to provide a spray as shown in FIG. 5. The arrangement of FIGS. 5 and 6 is preferred but the side openings 80 of FIG. 4 can be used to reduce restriction of water flow into chamber 74. In order to limit the two extreme movements of the external actuating arm 84, the gate is provided with symmetric peripheral stops 100 to abut the spaced stops 62 on peripheral side wall 60 of the cup on the housing.

For evenly clamping the parts together, a U-shaped spring 102 is formed with its upper leg 104 placed to abut the gate projection 86 centrally of disc 72 so that pressure is evenly distributed on the closure formed by projection 86 to compress and seal the projection tightly against the protruding annular walls 76, 80 and 92 in a half O-ring type seal to form a watertight chamber 74. Location of the spring is enhanced by a suitable matching detent 106 formed in the upper leg 104 and projection 86 as seen in FIG. 3. This ensures a positive central even pressure distribution on the parts. The bottom of the spring may be similarly formed of a pair of straddling legs 108 with similar detents, legs 108 straddling the various tubes and holding against the underside of valve housing 54.

The above rather detailed structure permits use of the mode selector valve subassembly of FIG. 6 of essentially four, preferably plastic, easily processed parts (three molded, one stamped) that fit together in only one manner for proper orientation of the parts. Thus, the off center position of outlets 66 ensures that the entire elastomer molded cup disc 72 and tubes can be inserted in the cup formed by walls 60 in only one oriented manner. Similarly, the stops 62 and 100 permit only one orientation of operating actuating arm 84 for selection of one of the multiple functions of spray and/or surge. Finally, the arrangement permits the assembly operator to direct the water inlet tube 70 and spray tube 68 to be easily connected within the iron as shown in FIG. 1 while then using the other already-assembled tube 96 to the other function such as surge, to be easily connected to the bottom of the remaining outlet at nipple 90. The snap-in barbs 58 on the housing 54, whether single or double, permits anchoring the entire subassembly to the iron handle and holds the subassembly in place during assembly of the iron while providing a sturdy base for actuating arm 84.

As a result, a few parts, easily moldable, inexpensive subassembly for multiple choice functions can be handled by an assembly line operator with all the parts falling together in only one necessarily tight sealing fitting and the easy assembly of the various tubing for the selected multiple functions.

While I have hereinbefore described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In an electric flatiron with plural surge and spray functions, a water tank, steam generating soleplate with ports for distributing normal steam and/or extra surge steam on demand, a handle with spray means and a pump connected to said tank with a button on said handle for manual pump actuation to deliver water to the soleplate surge or handle spray means as directed by a separate handle-mounted mode selector valve subassembly, an improvement in said mode valve comprising, a molded cup-shaped valve housing with an upright closed peripheral side wall with spaced stops, said side wall enclosing a flat bottom wall and all mounted within said handle, a plurality of outlets through the bottom wall, an integral flexible seal including a cup-shaped disc with molded integral tubes extending through said outlets to seat the disc in said housing, said disc having separate annular walls around each outlet protruding into said housing cup forming a chamber therein, a flat gate with an actuating arm through the iron handle, said gate having a projection rotatably nesting snugly in the cup housing to seal against the protruding walls, an arcuate channel in said projection connecting only two outlets, means clamping and compressing said gate and disc together, said gate having peripheral stops to abut said spaced stops, whereby said actuating arm external of the handle is rotatable against said stops to selectively direct water to the spray and extra surge functions on separate pump actuation.

2. Apparatus as described in claim 1 wherein said clamping means comprises a U-shaped spring with one leg atutting the gate projection centrally of said disc for even pressure distribution and sealing between said projection and each tube protruding outlet wall.

3. Apparatus as described in claim 2 wherein said arcuate channel is disposed to always connect said tube protruding wall with one of the connected two outlets to channel chamber water to one of the selected outlets.

4. Apparatus as described in claim 3 wherein said plurality of outlets comprises a pair of adjacent off-center outlets with one of said molded integral tubes extending to form a water inlet through said tube protruding wall to the chamber, the other tubed outlet connecting with one of said plural functions.

5. Apparatus as described in claim 4 wherein the plurality of outlets includes a third outlet from the flat bottom wall, said third outlet including a stepped housing molded extension to receive a removable flexible tubing from one of said plural functions, whereby the subassembly may be mounted in an iron by final attachment of a single tube to said stepped extension.

* * * * *